US008777285B1

(12) United States Patent
Howell

(10) Patent No.: US 8,777,285 B1
(45) Date of Patent: Jul. 15, 2014

(54) UNDERWATER CABLE CAPTURE AND PASS THROUGH DEVICE

(71) Applicant: W. Scott Howell, Panama City, FL (US)

(72) Inventor: W. Scott Howell, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/965,992

(22) Filed: Aug. 13, 2013

(51) Int. Cl.
*B66C 1/00* (2006.01)

(52) U.S. Cl.
USPC ..... 294/66.1; 294/82.2; 294/82.33

(58) Field of Classification Search
USPC ..... 294/66.1, 82.18, 82.2, 82.22, 82.31, 294/82.32, 82.33, 191
See application file for complete search history.

(56) References Cited

U.S. PATENT DOCUMENTS

| | | | | | |
|---|---|---|---|---|---|
| 768,069 | A * | 8/1904 | O'brien | 24/598.9 |
| 870,593 | A * | 11/1907 | Sprogis | 294/82.33 |
| 997,438 | A * | 7/1911 | Clough | 294/82.33 |
| 2,422,363 | A * | 6/1947 | Moore | 114/380 |
| 3,278,217 | A * | 10/1966 | Turner, Sr. | 294/82.18 |
| 3,383,721 | A * | 5/1968 | Adams, Jr. | 114/365 |
| 2011/0042984 | A1 * | 2/2011 | Rocourt et al. | 294/82.33 |

* cited by examiner

*Primary Examiner* — Saul Rodriguez
*Assistant Examiner* — Gabriela Puig
(74) *Attorney, Agent, or Firm* — James T. Shepherd

(57) ABSTRACT

A cable capture/release (CCR) device defines an open slot and an annular channel. The CCR device is coupled to a housing at a first pivot point wherein the slot is maintained outside of the housing. A sliding coupler engages the annular channel and extends to an attachment point. A tow point on the housing and the attachment point are aligned along a line of force when the housing is towed, while the first pivot point is out of alignment with the line of force. A trigger is coupled to the housing at a second pivot point. A latch, coupled to the housing at a third pivot point, defines first and second latch elements. The first latch element engages a perimeter of the CCR device and the second latch element engages the trigger.

6 Claims, 5 Drawing Sheets

UNDERWATER CABLE CAPTURE AND PASS THROUGH DEVICE

ORIGIN OF THE INVENTION

The invention described herein may be manufactured and used by or for the Government of the United States of America for Governmental purposes without payment of any royalties.

FIELD OF THE INVENTION

The invention relates generally to underwater cable capture mechanisms, and more particularly to an underwater cable capture device that is towed through the water for capturing an underwater cable momentarily and then allowing the cable to pass through the device.

BACKGROUND OF THE INVENTION

Currently, moored mine neutralization involves sweeping an array of cable cutters through the water to sever mooring cables allowing the mines to float to the water's surface. Neutralizing these floating mines requires visual engagement and subsequent destruction by a rifle or large caliber weapon. If the floating mines are concealed at the water's surface (e.g., by an oil slick of thick crude oil or a mat of seaweed), the floating mines cannot be visually sighted and cannot be neutralized. This constitutes a potentially hazardous situation as the floating mines are adrift.

A new approach to mine marking and/or neutralization involves coupling a marker and/or a neutralizer to a mine's mooring cable. To do this, some type of cable capture device is needed in order to allow a marker/neutralizer to be attached to the mooring cable. However, since such a cable capture device would typically be towed through the water, it would be best for the cable capture device to release from the mooring cable to avoid dragging a moored mine through the water.

SUMMARY OF THE INVENTION

Accordingly, it is an object of the present invention to provide a device that can be towed through the water, momentarily capture a mooring cable, and then release from the mooring cable.

Other objects and advantages of the present invention will become more obvious hereinafter in the specification and drawings.

In accordance with the present invention, a towed cable-capture-and-pass-through device includes a housing defining a tow point. The housing is adapted to be towed through water via the tow point. A cable capture/release (CCR) device defines a radially extending and open-ended slot, and a substantially annular channel formed therein. The CCR device is disposed partially in the housing and pivotally coupled thereto at a first pivot point wherein the slot is maintained outside of the housing. A sliding coupler defines a portion of an annular flange for sliding engagement in the annular channel of the CCR device. The sliding coupler extends from the CCR device to an attachment point that is external to the housing. The tow point and attachment point are aligned along a line of force when the housing is towed through the water via the tow point, while the first pivot point is out of alignment with the line of force. A trigger is pivotally coupled to the housing at a second pivot point and extends into the CCR device. A latch is pivotally coupled to the housing at a third pivot point. The latch defines a first latch element and a second latch element wherein, when the trigger extends across the slot of the CCR device, the first latch element engages a perimeter of the CCR device and the second latch element simultaneously engages the trigger.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
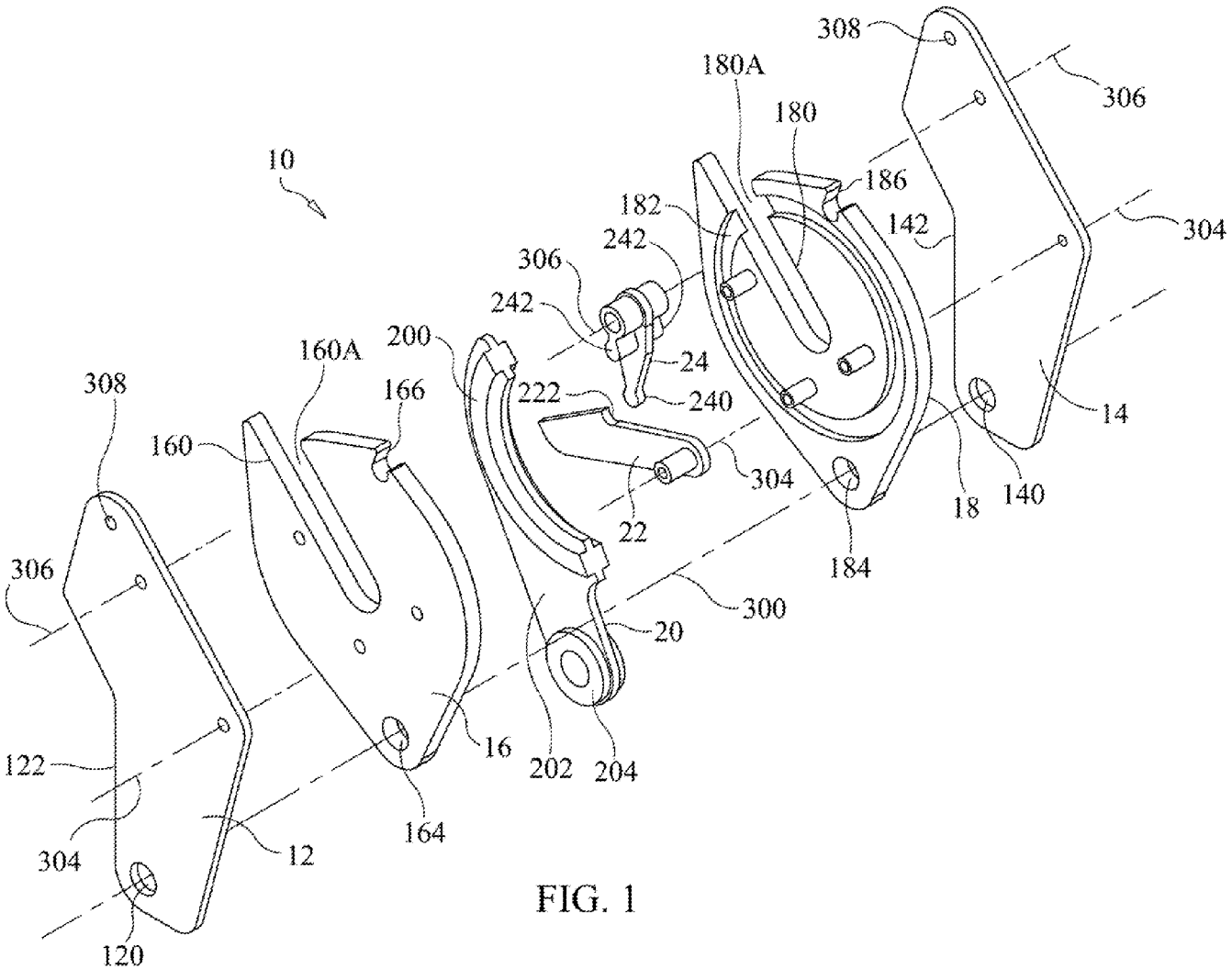
FIG. 1 is an exploded view of a cable-capture-and-pass-through device in accordance with an embodiment of the present invention.
Figure 2:
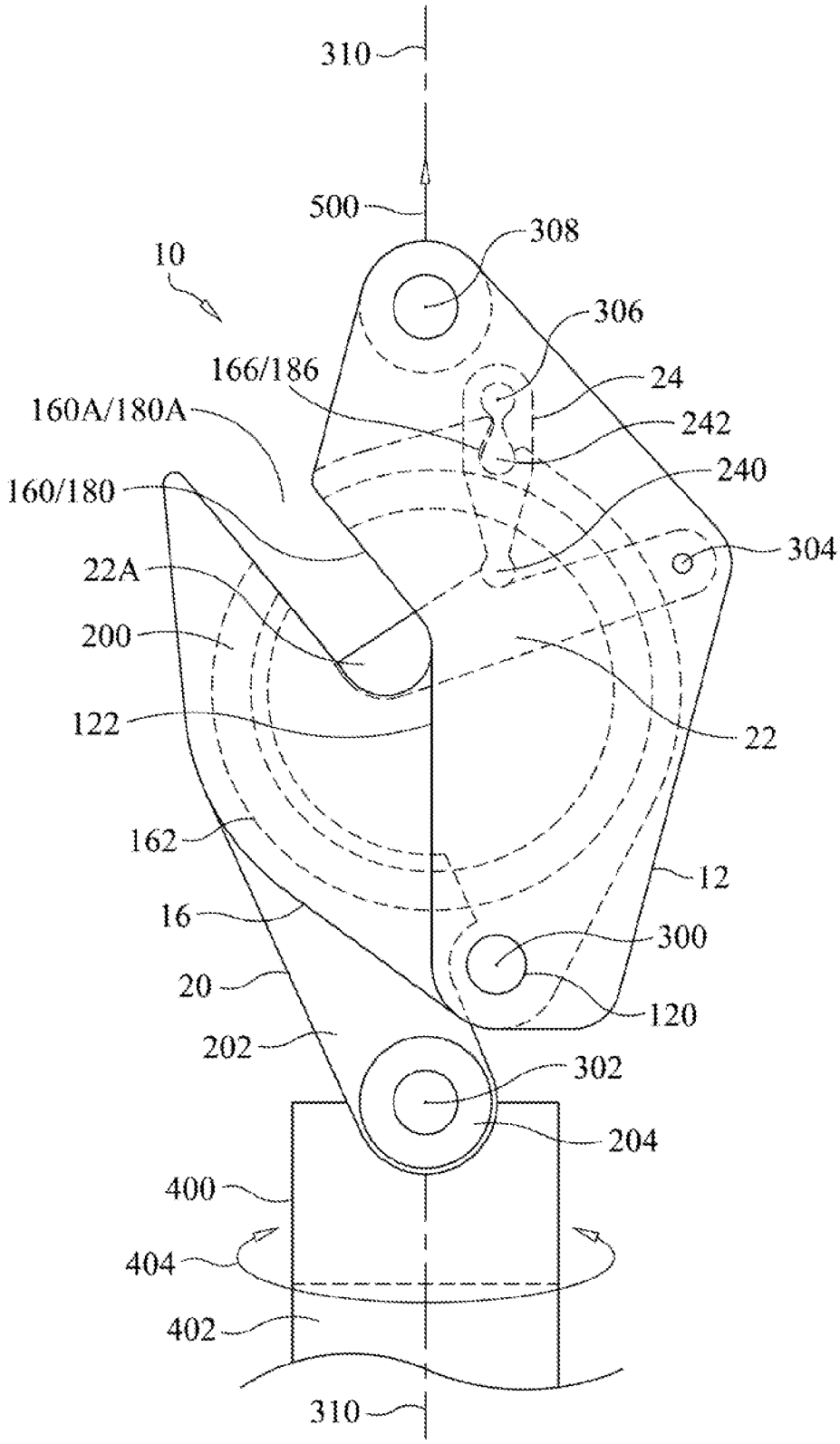
FIG. 2 is a plan view of the cable-capture-and-pass-through device in its latched position.

Referring now to the drawings and more particularly to FIGS. 1 and 2, a "cable-capture-and-pass-through" (CCPT) device in accordance with the present invention is shown and is referenced generally by numeral 10. FIG. 1 shows CCPT device 10 in an exploded view and FIG. 2 shows CCPT device 10 in a plan view after the assembly thereof. Following a description of the parts of CCPT device 10, an operational description thereof will be provided with reference to the sequence of events depicted in FIGS. 3-5.

CCPT device 10 (or just "device 10" as it will be referred to hereinafter) includes an outer housing formed from substantially L-shaped plates 12 and 14, a "cable capture/release" (CCR) device/assembly formed from two substantially circularly-shaped plates 16 and 18, a sliding coupler 20, a trigger 22, and a latch 24. Note that only plates 12 and 16 are visible in FIG. 2. For clarity of illustration, the various fasteners and hinge pins used during assembly of device 10 have been omitted. However, the various hinging or pivot points used by device 10 will be shown and described herein.

In general, plates 16 and 18 are mirror images of one another and are configured such that, when assembled, a portion of sliding coupler 20 is captured there between, and portions of trigger 22 and latch 24 can be received therein. Each of plates 16 and 18 has a radially extending slot 160 and 180, respectively, formed therein with slots 160 and 180 being open at ends 160A and 180A. When plates 16 and 18 are assembled, slots 160 and 180 are aligned with one another as are open ends 160A an 180A. The alignment of the slots and open ends is indicated in the figures by reference numerals 160/180 and 160A/180A, respectively.

Each of plates 16 and 18 has a channel 162 (visible in FIG. 2) and 182 (visible in FIG. 1), respectively, formed therein that begins/ends at slot 160 and 180, respectively, and extend in a circular/annular fashion. When plates 16/18 are assembled to one another, channels 162/182 are aligned and adjoined to define a closed and substantially annular channel within device 10. Plates 16 and 18 also have holes 164 and 184 that align with holes 120 and 140 in plates 12 and 14, respectively. Aligned holes (referenced by dashed line 300) are pinned together by a hinge pin (not shown) such that assembled plates 16/18 are rotatable relative to assembled plates 12/14. That is, dashed line 300 represents a first pivot point of device 10. A notch 166 and 186 is formed in a perimeter of each of plates 16 and 18, respectively, for engagement with a portion of latch 24 as will be described later herein.

Sliding coupler 20 defines a flange 200 sized/shaped to slidingly fit in and be captured by the annular channel formed by adjoining channels 162 and 182. As a result, sliding coupler 20 can move relative to assembled plates 16/18 as defined by adjoining channels 162/182. Sliding coupler 20 includes a plate 202 integrated with flange 200. Assembled plates 16/18 define a peripheral space through which plate 202 extends and can move (when flange 200 slides in channel 162/182). Plate 202 terminates in an attachment point 204 that is external to assembled plates 12/14 and plates 16/18 as best seen in FIG. 2. Attachment point 204 is coupled to a mount 400 at 302. Typically, mount 400 will be coupled to a line (not shown) used to support a plurality of devices 10 that are to be towed through the water. Mount 400 can include a swivel 402 such that mount 400 and sliding coupler 20 can swivel thereabout as indicated by two-headed arrow 404.

Trigger 22 is pivotally coupled to and between assembled plates 12/14 at a second pivot point 304 of device 10. Trigger 22 is sized to extend across slots 160/180 when plates 16/18 are assembled as illustrated in FIG. 2. Trigger 22 includes a notch 222 for engagement with latch 24 as will be explained below.

Latch 24 is pivotally coupled to and between assembled plates 12/14 at a third pivot point 306 of device 10. In general, latch 24 is used to define the latched position of device 10 (FIG. 2) whereby assembled plates 16/18 are prevented from rotating about first pivot point 300 and trigger 22 is prevented from rotating about second pivot point 304. More specifically, latch 24 includes a tip 240 that engages notch 222 on trigger 22, and includes a tab 242 (extending from opposing faces of latch 24) that engages aligned notches 166/186 of assembled plates 16/18.

Assembled plates 12/14 define tow point 308 for device 10. In the above-described latched position, tow point 308 and attachment point 204/302 are in linear alignment with one another as illustrated by dashed line 310 in FIG. 2. That is, if device 10 is pulled/towed along line 310 while device 10 is in its latched position, a line of force will be defined along line 310. Further, in the device's latched position, first pivot-point 300 is not aligned with line 310 and is off to one side thereof.

Assembled plates 12/14 define a side opening defined by aligned edges 122/142 that allow assembled plates 16/18 to extend therefrom. In the device's latched position (FIG. 2), aligned slots 160/180 are positioned outside of assembled plates 12/14 so that a portion 22A of trigger 22 is exposed where trigger 22 extends across slots 160/180. Aligned slots 160/180 lie on the opposing side of line 310 relative to first pivot point 300.

Figure 3:
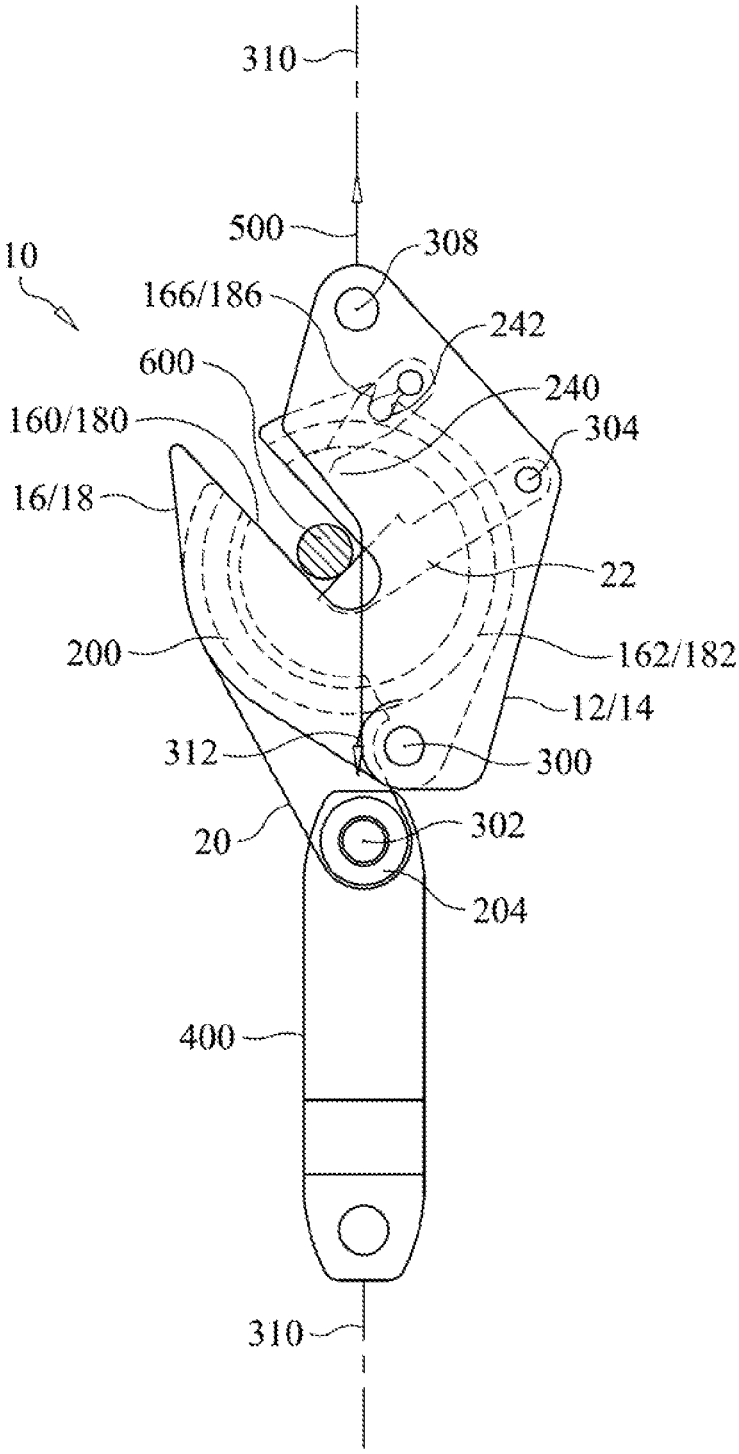
FIG. 3 is a plan view of the cable-capture-and-pass-through device immediately after the capture of a cable therein causes the device to be unlatched.

Referring additionally now to a sequence of events depicted in FIGS. 3-5, the capture and release of a cable 600 by device 10 will be described. To maintain clarity in these illustrations, only the reference numerals critical to understanding the particular event are shown. Further, the assembled mirror image plates 12/14 and 16/18, and their resulting mirror image structures, are referenced simultaneously in FIGS. 3-5. In this sequence, it is assumed that device 10 is being towed through the water by a towing force applied along line 310 as indicated by arrow 500. In FIG. 3, cable 600 has been captured in aligned slots 160/180 and towing force 500 causes cable 600 to push on trigger 22. As a result, trigger 22 rotates slightly in a counterclockwise direction about second pivot point 304 to disengage from tip 240. Once this occurs, the continued tension force in cable 600 on one side of line 310 combined with the position of first pivot point 300 on the other side of line 310 causes a rotational force 312 between assembled plates 16/18 and assembled plates 12/14 at first pivot point 300. Rotational force 312 causes tab 242 to disengage from aligned notches 166/186 thereby allowing assembled plates 16/18 to rotate about first pivot point 300.

Figure 4:
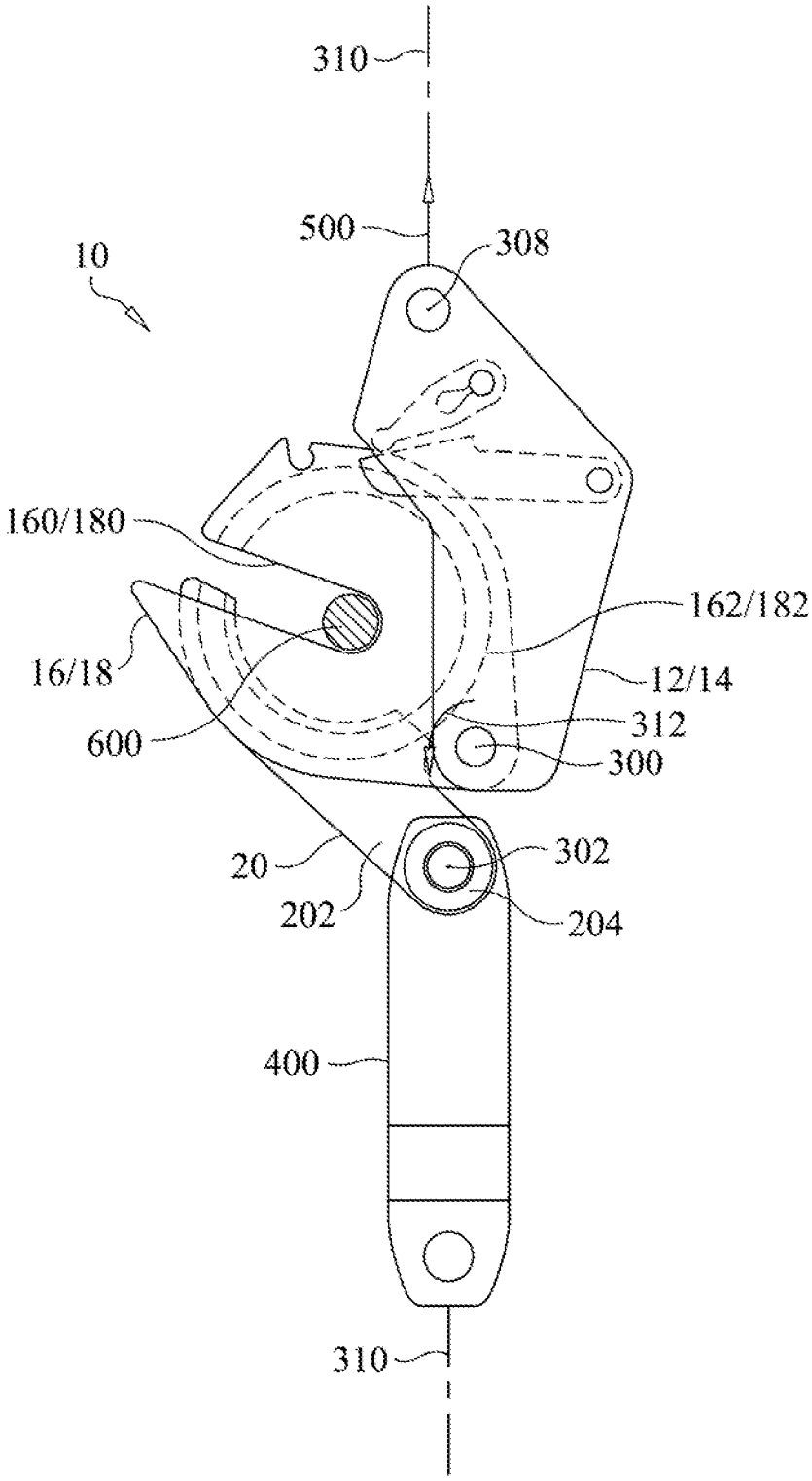
FIG. 4 is a plan view of the cable-capture-and-pass-through device after the device's cable capture/release assembly has begun rotation towards the cable release position.
Figure 5:
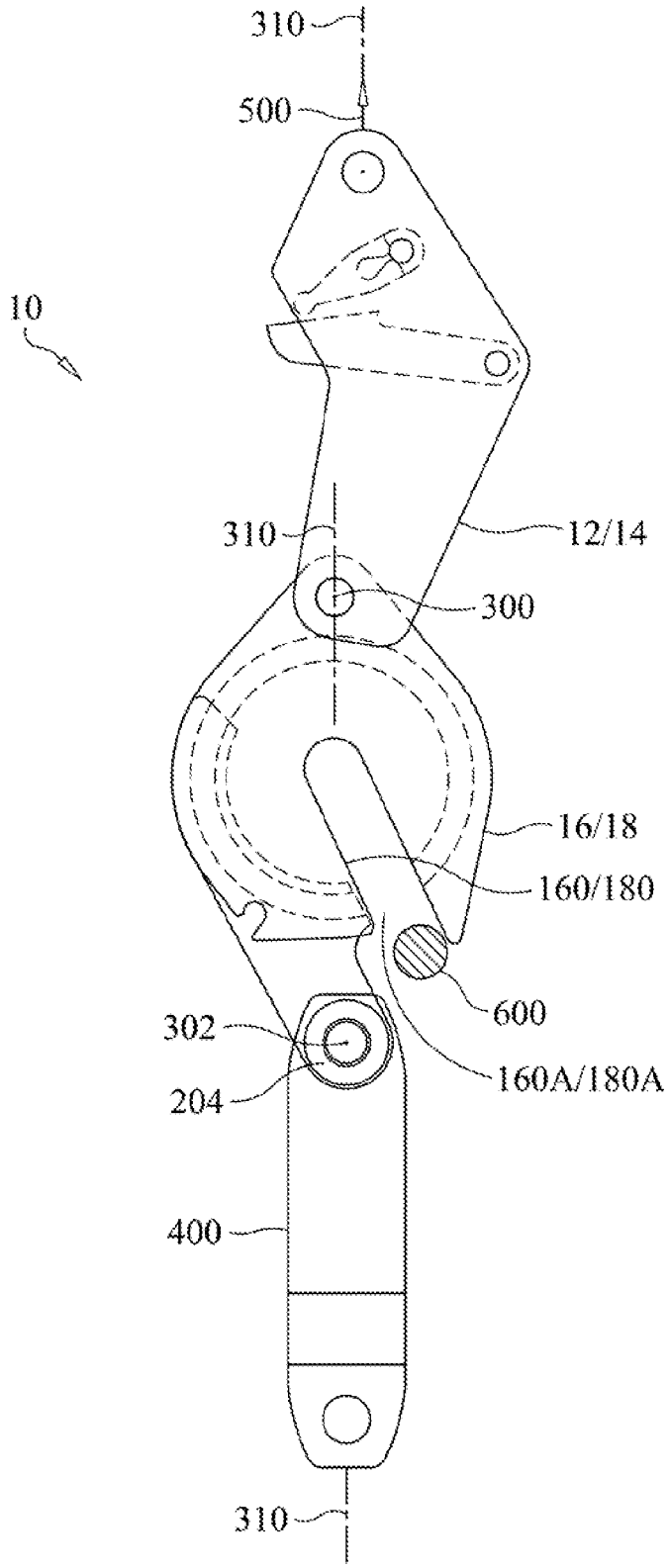
FIG. 5 is a plan view of the cable-capture-and-pass-through device after the device's cable capture/release assembly has fully rotated to the cable release position.

Rotation force 312 about first pivot point 300 continues with cable 600 in aligned slots 160/180 as shown in FIG. 4. However, such rotation about first pivot point 300 ceases when attachment point 204/302, first pivot point 300, and tow point 309 are aligned with towing force 500 as shown in FIG. 5. When this occurs, open ends 160A/180A of aligned slots 160/180 face approximately 180° away from towing force 500 so that cable 600 is released by device 10.

The advantages of the present invention are numerous. The CCPT device can be used to briefly capture a moored cable and then be released therefrom. This momentary capture time can be used to deploy an ancillary device on the captured and subsequently released cable.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A towed cable-capture-and-pass-through device, comprising:

a housing defining a tow point, said housing adapted to be towed through water via said tow point;

a cable capture/release (CCR) device defining a radially extending and open-ended slot, and further defining a substantially annular channel formed therein, said CCR device disposed partially in said housing and pivotally coupled thereto at a first pivot point wherein said slot is maintained outside of said housing;

a sliding coupler defining a portion of an annular flange for sliding engagement in said substantially annular channel of said CCR device, said sliding coupler extending from said CCR device to an attachment point that is external to said housing, said attachment point adapted to be coupled to a mount, wherein said tow point and said attachment point are aligned along a line of force when said housing is towed through the water via said tow point, and wherein said first pivot point is out of alignment with said line of force;

a trigger pivotally coupled to said housing at a second pivot point and extending into said CCR device; and a latch pivotally coupled to said housing at a third pivot point, said latch defining a first latch element and a second latch element wherein, when said trigger extends across said slot of said CCR device, said first latch element engages a perimeter of said CCR device and said second latch element simultaneously engages said trigger.

2. A towed cable-capture-and-pass-through device as in claim 1, wherein said CCR device extends from said housing on one side of said line of force and said first pivot point is disposed on another side of said line of force.

3. A towed cable-capture-and-pass-through device, comprising:

a two-piece housing that, when assembled, defines a tow point and a side opening, said housing so-assembled adapted to be towed through water via said tow point;

a two-piece cable capture/release (CCR) assembly defining a radially extending and open-ended slot, and further defining a substantially annular channel formed therein, said CCR assembly disposed partially in said housing so-assembled to extend from said side opening thereof and pivotally coupled to said housing so-assembled at a first pivot point wherein said slot is maintained outside of said housing so-assembled;

a sliding coupler defining a portion of an annular flange for sliding engagement in said substantially annular channel of said CCR assembly, said sliding coupler extending from said CCR assembly to an attachment point that is external to said housing so-assembled, said attachment point adapted to be coupled to a swiveling mount, wherein said tow point and said attachment point are aligned along a line of force when said housing so-assembled is towed through the water via said tow point, and wherein said first pivot point is positioned off to one side of said line of force;

a trigger pivotally coupled to said housing so-assembled at a second pivot point and extending into said CCR assembly; and a latch pivotally coupled to said housing so-assembled at a third pivot point, said latch defining a first latch element and a second latch element wherein, when said trigger extends across said slot of said CCR assembly, said first latch element engages a perimeter of said CCR assembly and said second latch element simultaneously engages said trigger.

4. A towed cable-capture-and-pass-through device as in claim 3, wherein said CCR assembly extends from said housing so-assembled on another side of said line of force relative to said one side of said line of force on which said first pivot point is positioned.

5. A towed cable-capture-and-pass-through device, comprising:

a two-piece housing that, when assembled, defines a tow point and a side opening, said housing so-assembled adapted to be towed through water via said tow point;

a two-piece cable capture/release (CCR) assembly defining a radially extending slot having an open end, and further defining a substantially annular channel formed therein, said CCR assembly disposed partially in said housing so-assembled to extend from said side opening thereof and pivotally coupled to said housing so-assembled at a first pivot point wherein said slot is maintained outside of said housing so-assembled;

a sliding coupler defining a portion of an annular flange for sliding engagement in said substantially annular channel of said CCR assembly, said sliding coupler extending from said CCR assembly to an attachment point that is external to said housing so-assembled, said attachment point adapted to be coupled to a swiveling mount, wherein said tow point and said attachment point are aligned along a line of force when said housing so-assembled is towed through the water via said tow point, and wherein said first pivot point is positioned off to one side of said line of force;

a trigger pivotally coupled to said housing so-assembled at a second pivot point and extending into said CCR assembly; and a latch pivotally coupled to said housing so-assembled at a third pivot point, said latch defining a first latch element and a second latch element, wherein, when said trigger extends across said slot of said CCR assembly, said first latch element engages a perimeter of said CCR assembly and said second latch element simultaneously engages said trigger, and wherein, when said housing so-assembled is towed through the water and said trigger is rotated about said second pivot point such that said trigger moves away from said open end of said slot, said CCR assembly rotates about said first pivot point until said tow point, said first pivot point and said attachment point are aligned along said line of force.

6. A towed cable-capture-and-pass-through device as in claim 5, wherein said CCR assembly extends from said housing so-assembled on another side of said line of force relative to said one side of said line of force on which said first pivot point is positioned.

* * * * *